US009931626B2

(12) United States Patent
Voyeux et al.

(10) Patent No.: US 9,931,626 B2
(45) Date of Patent: Apr. 3, 2018

(54) POSITIVE DISPLACEMENT PIPETTING SYSTEM, HAVING A DESIGN FACILITATING THE GRIPPING OF THE PISTON OF THE CAPILLARY-PISTON ASSEMBLY

(71) Applicant: GILSON SAS, Villiers le Bel (FR)

(72) Inventors: Claude Voyeux, Goussainville (FR); Stephane Guichardon, Bougival (FR)

(73) Assignee: GILSON SAS, Villiers le Bel (FR)

( * ) Notice: Subject to any disclaimer, the term of this patent is extended or adjusted under 35 U.S.C. 154(b) by 0 days.

(21) Appl. No.: 15/034,833

(22) PCT Filed: Nov. 4, 2014

(86) PCT No.: PCT/EP2014/073631

§ 371 (c)(1),
(2) Date: May 5, 2016

(87) PCT Pub. No.: WO2015/067579

PCT Pub. Date: May 14, 2015

(65) Prior Publication Data

US 2016/0271602 A1 Sep. 22, 2016

(30) Foreign Application Priority Data

Nov. 7, 2013 (FR) ..... 13 60906

(51) Int. Cl.
*B01L 3/02* (2006.01)

(52) U.S. Cl.
CPC ..... *B01L 3/022* (2013.01); *B01L 3/0279* (2013.01); *B01L 3/0286* (2013.01);
(Continued)

(58) Field of Classification Search
USPC ..... 422/520
See application file for complete search history.

(56) References Cited

U.S. PATENT DOCUMENTS 3,525,264 A * 8/1970 Cybulsky ..... A61M 1/00 422/501
4,050,316 A * 9/1977 Rapoza ..... B01L 3/022 422/924

(Continued)

FOREIGN PATENT DOCUMENTS

DE 2647883 5/1977
DE 10 2008 058 067 A1 5/2010

(Continued)

OTHER PUBLICATIONS

Non-Final Office Action dated Feb. 9, 2017 for related U.S. Appl. No. 14/345,294.

(Continued)

*Primary Examiner* — Jill A Warden
*Assistant Examiner* — Brittany I Fisher
(74) *Attorney, Agent, or Firm* — Miles & Stockbridge P.C.

(57) ABSTRACT

A pipetting system including a positive displacement sampling pipette as well as a capillary-piston assembly, the piston of which has a top end intended to be held by a gripping device equipping the pipette, the device including a plurality of gripping tongs. The system is designed so that, when the capillary is fitted on the pipette tip and the gripping device is remote from the piston upwards, this device can be displaced downwards with its tongs in an open configuration, up to a determined position in which the tongs, arranged around the top end of the piston, automatically switch into a closed configuration in which they provide a holding of the top end of the piston.

9 Claims, 10 Drawing Sheets

(52) U.S. Cl.
CPC ... *B01L 2200/087* (2013.01); *B01L 2200/141* (2013.01); *B01L 2300/0838* (2013.01); *B01L 2400/0478* (2013.01)

(56) References Cited

U.S. PATENT DOCUMENTS

| | | | | |
|---|---|---|---|---|
| 4,099,548 | A | 7/1978 | Sturm et al. | |
| 4,154,108 | A * | 5/1979 | Vollinger | B01L 3/0224 422/925 |
| 4,362,064 | A * | 12/1982 | Marteau d'Autry | B01L 3/0217 422/923 |
| 4,567,780 | A * | 2/1986 | Oppenlander | B01L 3/0224 422/525 |
| 4,616,514 | A * | 10/1986 | Magnussen, Jr. | B01L 3/0227 403/369 |
| 4,830,832 | A * | 5/1989 | Arpagaus | B01L 3/0217 422/509 |
| 5,021,217 | A * | 6/1991 | Oshikubo | B01L 3/0217 422/516 |
| 5,413,006 | A | 5/1995 | D'Autry | |
| 7,320,260 | B2 | 1/2008 | Belgardt | |
| 2005/0155438 | A1 * | 7/2005 | Belgardt | B01L 3/0217 73/864.01 |
| 2011/0076205 | A1 | 3/2011 | Kelly et al. | |
| 2014/0298925 | A1 | 10/2014 | Voyeux et al. | |
| 2016/0051978 | A1 | 2/2016 | Voyeux et al. | |

FOREIGN PATENT DOCUMENTS

| | | |
|---|---|---|
| EP | 0014120 A1 | 8/1980 |
| EP | 032469 | 7/1981 |
| EP | 0078724 A1 | 5/1983 |
| FR | 2446672 A1 | 8/1980 |
| FR | 2980123 A1 | 3/2013 |
| JP | 4225845 | 8/1992 |

OTHER PUBLICATIONS

International Search Report and Written Opinion issued in PCT/EP2012/068294, dated Dec. 11, 2012.
International Preliminary Examination Report issued in PCT/EP2012/068294, dated Sep. 10, 2013.
English language translation of the International Preliminary Examination Report issued in PCT/EP2012/068294.
Office Action dated Jul. 18, 2016 for related U.S. Appl. No. 14/345,294.
International Search Report dated May 8, 2014 for International Application No. PCT/EP2014/055769.
French Search Report dated Feb. 3, 2014 for French Application No. 1352660.
Preliminary French Search Report for FR1360906 (dated Jul. 30, 2014).
International Search Report for PCTEP2014073631 (dated Aug. 1, 2015).
Notice of Allowance dated Dec. 29, 2017 for related U.S. Appl. No. 14/779,518.
Notice of Allowance dated Jul. 5, 2017 for related U.S. Appl. No. 14/345,294.
Non-Final Office Action dated Jun. 29, 2017 for related U.S. Appl. No. 14/779,518.

* cited by examiner

POSITIVE DISPLACEMENT PIPETTING SYSTEM, HAVING A DESIGN FACILITATING THE GRIPPING OF THE PISTON OF THE CAPILLARY-PISTON ASSEMBLY

TECHNICAL FIELD

The present invention relates to the field of pipetting systems comprising a positive displacement sampling pipette, as well as a capillary-piston assembly the capillary of which is fitted on a tip of the pipette.

The positive displacement pipettes are indeed intended to cooperate with consumables of the capillary-piston type, the piston of which is provided to be directly in contact with the sample to be sampled, before being ejected or reused. The positive displacement pipettes then have a different design from the one of more conventional air displacement pipettes, in which the piston is integral with the pipette.

STATE OF PRIOR ART

The positive displacement pipettes are usually used for sampling viscous, volatile and/or contaminating liquids. Their association with consumables of the "capillary-piston" type makes it possible to prevent the pipette from being contaminated.

Such a pipette is for example known from FR 2 446 672 and FR 2 980 123.

On the conventional positive displacement pipettes of the type described in FR 2 446 672, it is provided a control stem the bottom end of which operates the displacement of a gripping device of the top end of a piston, belonging to a capillary-piston assembly intended to cooperate with the pipette. This gripping device is also referred to as "tongs".

The pipette is designed so as to be able to exert two successive downward strokes with the control stem, via a control knob arranged at its top end. The first stroke of the control stem corresponds to the stroke for dispensing the sampled sample. It is made by opposing the return force of a first spring, preferably a compression spring. The second stroke of the control stem corresponds to the presentation and opening of the piston gripping tongs. It is made by opposing the return force of a second spring, preferably a compression spring, arranged along the same direction as the first spring and having a much more significant stiffness.

More precisely, this second stroke results in extracting the tongs from a sheath sandwiching them. Once the tongs are released from their sheath, they can easily let through the top end of the piston upon installing the consumable on the pipette, which also simultaneously undergoes the fitting of the capillary on the tip of the pipette.

The first phase of raising the control stem, under the effect of the return force of the second spring, results in retracting the tongs in the sheath, with the top end of the piston held by the tongs in a tightened position. The second phase of raising the control stem, under the effect of the return force of the first spring having a lower stiffness, leads to displacing this stem as well as the tongs sandwiching the piston up to a top position, with respect to the pipette body.

Nevertheless, the second stroke is made using only the operator's thumb, by counteracting the return force of the second spring which is necessarily substantial in order to contrast with the return force of the first spring, and therefore be able to fulfil its delivery function of a sensitive signal to the operator at the end of the first stroke, corresponding to the pipetting stroke.

In order to improve this aspect, it has been provided the pipette such as described in FR 2 980 123. In the provided design, the eject function is separated from the pipetting function. The introduction of the top end of the piston between the tongs is made without having to counteract the return force of the second spring with a significant stiffness. Indeed, when the fitting of the capillary is completed, the introduction of the piston between the tongs is then initiated and made by a simple displacement of the control stem, thanks to an action requiring a smaller effort from the operator, essentially conditioned by the stiffness of the return elastic means surrounding the tongs. These elastic means must however have a significant stiffness to provide a function of holding the piston during the pipetting operations. Also, with this solution, there exists a compromise which is difficult to be found between a sufficiently significant stiffness to enable such a holding of the piston, and a sufficiently small stiffness so as not to create problems for the operator performing repeated pipetting operations.

Consequently, there is a need for further optimizing the ergonomics of the pipette, for this phase of introducing the top end of the piston between the tongs.

DISCLOSURE OF THE INVENTION

The purpose of the invention is therefore to at least partially overcome the abovementioned drawbacks related to the prior art implementations.

To do so, the object of the invention is a pipetting system comprising a positive displacement sampling pipette as well as a capillary-piston assembly the capillary of which is intended to be fitted on a tip of the pipette, and the piston of which has a top end intended, during the pipetting operations, to be held by a gripping device equipping the pipette, said gripping device comprising a plurality of gripping tongs.

According to the invention, the system is designed so that when the capillary of the capillary-piston assembly is fitted on the pipette tip and said gripping device is remote from the piston upwards, the gripping device can be displaced downwards with its tongs in an open configuration, up to a determined position in which the tongs, arranged around the top end of the piston, automatically switch into a closed configuration in which they provide a holding of the top end of the piston.

Also, the invention is remarkable in that the introduction of the top end of the piston is made with the tongs arranged in an open configuration. There is therefore no particular force for the operator to exert in order to prise open the tongs at the time of this insertion. With this simplified gripping mechanism of the top end of the piston, the ergonomics of the pipette is substantially improved.

Preferably, said gripping device includes tong locking means in the open configuration, said locking means including an unlocking control member slidably mounted relative to the tongs. Moreover, the pipette is designed so that the automatic switching from the open configuration to the closed configuration is triggered by the displacement of the unlocking control member, caused by the top end of the piston bearing against this member, during said downward displacement of the gripping device.

Preferably, said gripping device includes:

- a head attached to the tongs;
- an outside body arranged around the head and the tongs, and including a sheath-shaped bottom end, enabling the tongs to be opened/closed as a function of its relative position with respect to these tongs it surrounds; and said tong locking means in the open configuration.

Preferably, said tong locking means form a locking system with balls. Nevertheless, any other automatic locking/unlocking principle can be implemented, without departing from the scope of the invention.

More particularly, said tong locking means include:

locking balls accommodated in holes of said head of the gripping device, said holes radially opening into the outside;

a groove provided on an inside surface of said outside body;

first elastic return means forcing the tongs and the head upwards relative to said outside body; and an axis system comprising at least one first portion and a second portion lower than the first portion, these first and second portions respectively having a first diameter as well as a second diameter smaller than the first diameter, and a lower end of this axis system being formed by said unlocking control member, Furthermore, said tong locking means are designed so that:

in the open configuration of the tongs, the locking balls radially protrude outwards from said holes of the head, by being partially accommodated in said groove in which they are held by contact with said first portion of the axis system, said first elastic return means bringing said locking balls in abutment against an axial top end of said groove; and when the second portion of the axis system is facing the locking balls, the combined actions of the first elastic return means and of the axial top end of the groove urge the locking balls to radially retract inwards in the holes of the head, until out of the groove and enabling said first elastic return means to cause an upward displacement of the tongs and the head relative to said outside body, up to a relative position bringing the tongs into a closed configuration, surrounded by the sheath-forming bottom end of the outside body.

Preferably, the system comprises second elastic return means arranged between the outside body of the gripping device, and a fixed element of the pipette.

Preferably, the system is designed so that during an eject operation of the capillary-piston assembly, obtained by depressing an eject button and then releasing said eject button, the tongs of said gripping device automatically switch from the closed configuration to the open configuration, the latter being kept at the end of said eject operation. Therefore, the tongs are ready again for the simplified gripping of the piston of a new capillary-piston assembly.

Preferably, said pipette includes a control stem for displacing the head and the tongs attached to this head.

According to a first possibility, said control stem is designed to fulfil the function of a pipetting control stem and the function of an eject stem of the capillary-piston assembly.

According to a second possibility, said control stem is designed to fulfil the function of an eject stem of the capillary-piston assembly, and the pipette further includes a pipetting control stem able to drive said gripping device into translation.

In the latter case, the invention is based on a design separating the elements enabling the pipetting operating function, and the capillary-piston consumable ejecting function.

More precisely, it is herein provided that ejecting the consumable is made by a dedicated stem, distinct from the control stem, in the manner described in FR 2 980 123. Also, the risks of incidental ejection of the consumable by the control stem are advantageously reduced to nothing. Upon handling the pipette according to the invention, the operator can activate the control stem without being concerned about the risks of such a loss, which generally enables the ergonomics, the reproducibility of the samplings, and the productivity to be improved.

These improvements are further enhanced by the ejection technology used, which is based on depressing the piston using the tongs, this same piston driving the capillary in its course by abutment. The force to be delivered to ensure the ejection of the consumable can therefore be relatively small, since it is no longer necessary to provide a high differential of stiffnesses between the first and second elastic return means, for the purpose of generating a sensory signal for the operator.

Further advantages and features of the invention will appear from the non-limiting detailed description below.

BRIEF DESCRIPTION OF THE DRAWINGS

This description will be made with reference to the accompanying drawings among which.

DETAILED DISCLOSURE OF PREFERRED EMBODIMENTS

Figure 1:
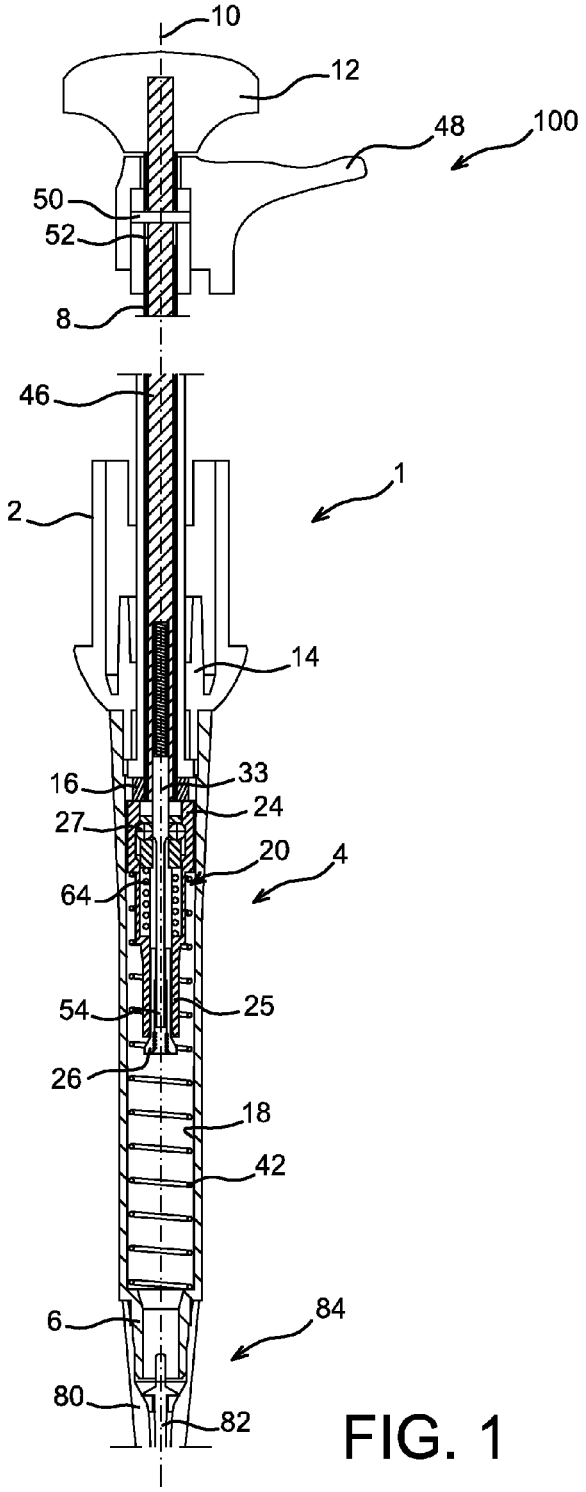
FIG. 1 depicts a longitudinal cross-section view of a positive displacement pipetting system, according to a preferred embodiment of the present invention.

With reference first to FIG. 1, it is depicted a pipetting system 100 according to a preferred embodiment of the present invention. The system 100 comprises a positive displacement sampling pipette 1, as well as a consumable capillary-piston assembly 84.

Throughout the following description, the terms "top" and "bottom" are to be considered with the pipette held vertically, in a pipetting position or close to this same position. Moreover, it is to be noted that the constituent elements of the pipetting system essentially have a revolution shape, centred on the longitudinal axis 10 of the pipette.

The pipette 1 has an outside body the top part of which forms a handle 2 for the operator, and the bottom part 4 of which is more tapered, ending towards the bottom by a tip 6 on which the capillary 80 of the assembly 84 is intended to be fitted. The bottom part 4 is preferentially mounted screwed on the handle forming body 2, so as to facilitate the assembly/disassembly.

The pipette incorporates a control stem 8, slidably accommodated inside the pipette outside body. The stem 8 is hollow, and arranged along the longitudinal axis 10 of the pipette. Its top end protrudes upwards from the handle forming body 2, and carries a control knob 12 intended to be activated by the operator's thumb holding the body 2 with one of his/her hands. By way of indication, the stem 8 has a transverse cross-section of a non-circular shape, here of a hexagonal or octagonal shape. It is slidably accommodated through a screw 14 for adjusting the volume to be sampled, the inside hollow part of which has a complementary shape to the outside surface of the stem 8, and the outside surface of which is threaded, mounted screwed on the lower end of the handle forming body 2.

In a known manner, rotating the control stem 8 by its knob 12 enables the adjustment screw to be displaced relative to the pipette outside body along the direction of the axis 10, and thus leads to a modification of the sample volume intended to be sampled.

The bottom end 16 of the control stem 8 is axially bearing against a gripping device 20 slidably mounted in a bore 18 formed by the bottom part 4 of the body outside pipette. It is a gripping device 20 of the top end of the piston 82 of the capillary-piston assembly 84, this top end being also referred to as a piston head.

The design of the gripping device 20 will be detailed with reference to FIGS. 1, 2*a* and 2*b*. First, it is indicated that in FIGS. 1 and 2*a*, the device 20 has gripping tongs in an open configuration in which they enable an easy effortless introduction of the top end of the piston 82, whereas in FIG. 2*b*, the device 20 has gripping tongs in a closed configuration in which they enable this top end of the piston 82 to be held during the pipetting operations.

The device 20 includes a head 21, also referred to as an ejection head, which extends downwards by gripping tongs 26, also referred to as jaws. There are two tongs or more. By way of indicating example, two tongs 26 are provided, as well as elastic return means 32 enabling both jaws to be returned in an open configuration, in which they are radially prised open. To do so, the means 32 can come as a spring placed inside the tongs 26, and radially biasing the latter outwards. Also, the generally annular shaped spring 32 has a diameter which can be reduced when it is radially stressed inwards, in the example shown in the figures, the spring 32 comes as a spiral spring biasing the inside surface of the tongs 26.

Around this integral assembly formed by the head 21 and the tongs 26, the device 20 includes an outside body 24 slidably mounted in the bore 18, and including a sheath-shaped bottom end 25 surrounding the tongs 26. The sheath 25 and the tongs 26 form together a mechanical bell. Thus, when the sheath 25 is in a top position with respect to the tongs 26, the latter protrude downwards and can be prised open under the effect of the spring 32, by placing them in the open configuration shown in FIG. 2*a*. In contrast, when the sheath 25 is displaced downwards along the tongs 26, the latter radially retract to reach their closed configuration shown in FIG. 2*b*. The radial strain of the sheath on the tongs therefore leads to bias the spring 32 so as to radially retract. In other words, opening/closing the tongs 26 is a function of the relative position of the sheath 25 with respect to these tongs 26 surrounded by this sheath. Finally, the gripping device 20 comprises tong locking means in the open configuration.

Preferably, the tong locking means form a locking system with balls. More precisely, the system includes locking balls 27 radially distributed, accommodated in holes 29 provided through the head 21 of the gripping device 20. These holes 29 radially open into the outside, facing a groove 31 of the axis 10 provided on an inside surface of the outside body 24.

The locking means also include first elastic return means, preferably a compression spring 64, forcing the assembly formed by the tongs 26 and the head 21 upwards, relative to the outside body 24. To do so, the spring 64 pressed between a top shoulder 66 provided on the head 21, and a bottom shoulder 68 provided on the inside surface of the outside body 24, in which this spring 64 is.

The locking means also comprise an axis system 33 comprising a first portion 33*a* and a second portion 33*b* lower than the first portion. These first and second portions 33*a*, 33*b* respectively have a first diameter as well as a second diameter smaller than the first, with a transition 33*c* having a frustoconical shape or similar, arranged between both portions 33*a*, 33*b*. It is to be noted that this axis system 33 is made in one piece, and that its lower end, integral with the lower portion 33*b*, forms an unlocking control member 54 which will be described below.

The axis system 33 is slidably mounted in a hole 35 of the eject stem 46. The hole 35 protrudes downwards and a compression spring 37 is interposed between the bottom of the hole 35, and a shoulder 39 provided on the axis system 33, at the first portion 33*a* having a larger diameter.

Figure 2A:
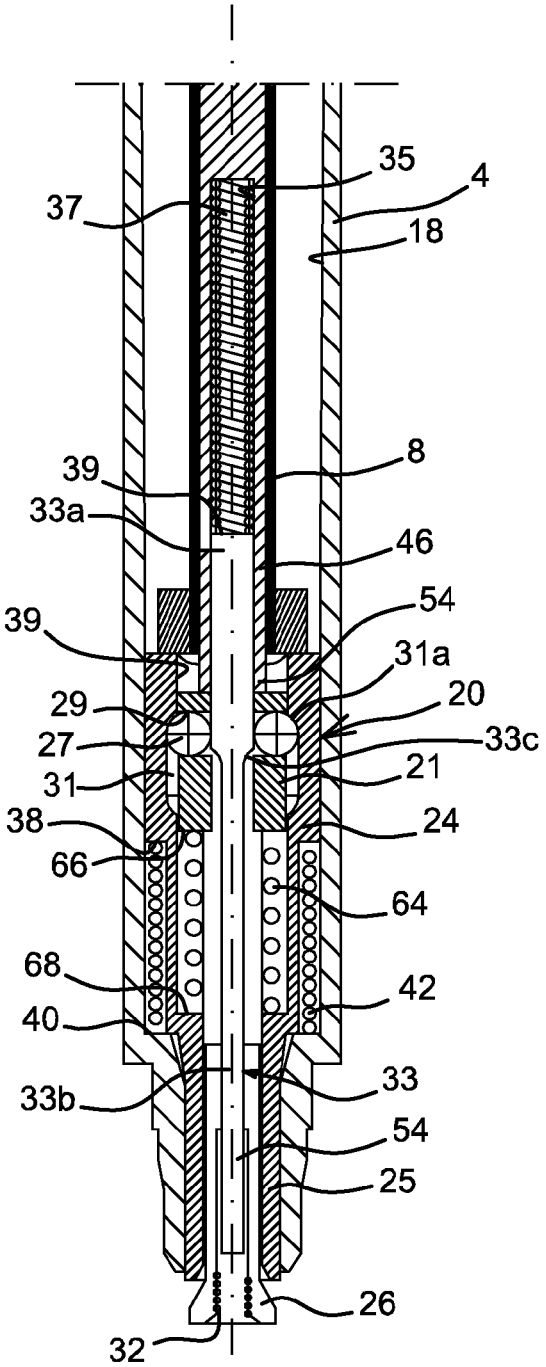
FIGS. 2*a* and 2*b* depict enlarged views of the gripping device equipping the pipetting system shown in the previous figure, in two different configurations.

In the open configuration of the tongs 26, shown in FIG. 2*a*, the locking balls 27 radially protrude outwards from the radial holes 29. These balls 27 are thus partially accommodated in the groove 31, by contacting the bottom of the latter. They are held at the bottom of the groove by an inner radial contact with the first portion 33*a* of the axis system 33 having a larger diameter, which prevents these balls from coming out of the groove. Moreover, the spring 64 pushes the head 21 and the balls 27 upwards relative to the outside body 24, which leads these balls in abutment against an axial top end 31*a* of the groove. By bearing against this top end 31*a*, the balls prevent the head 21 and the tongs 26 from reaching their top position relative to the body 24, which enables the sheath 25 to be held recessed and thus provides the locking of the gripping device 20 with its tongs in an open configuration.

Figure 2B:
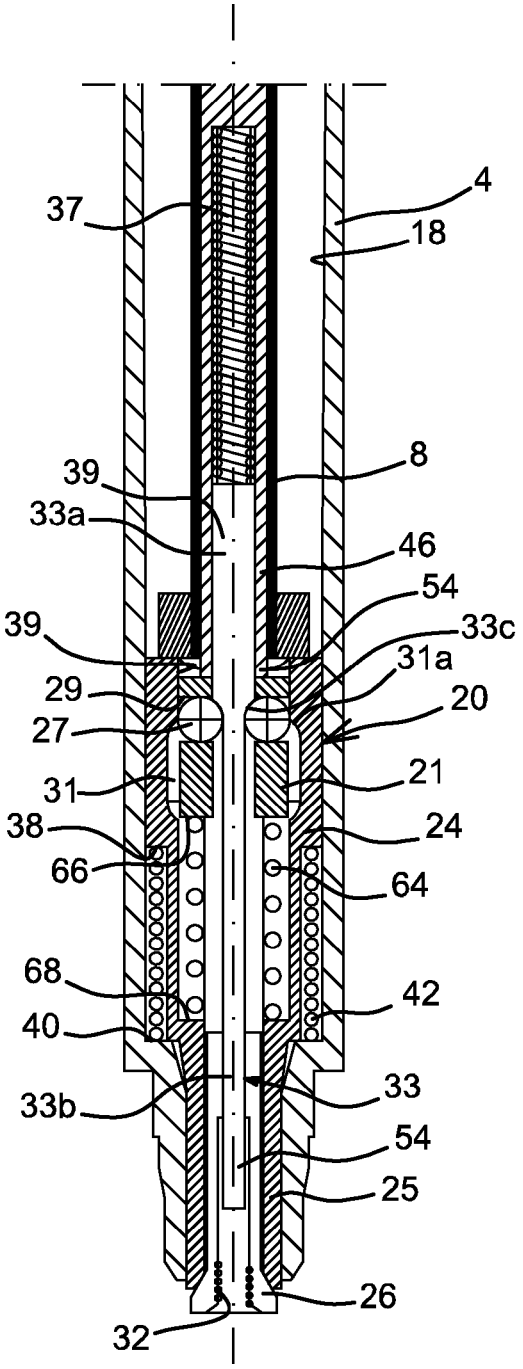

Furthermore, in the closed configuration of the tongs depicted in FIG. 2*b*, the balls 27 are located outside the groove 31, upwards, in outside radial contact on the bore 39 of the outside body 24. Moreover, these same balls are in inside radial contact with the second portion 33*b* having a smaller diameter of the axis system 33, which enables the head 21 and the tongs 26 to slide upwards relative to the body 24, under the effect of the expansion of the spring 64 and through sliding of the balls 27 on the bore 29. The top position is reached by a total expansion of the spring, and/or by a top abutment on the outside body 24 of the gripping device 20.

To obtain this closed configuration, the axis system 33 must displace relative to the eject stem 46, in the hole 35, by compressing the spring 37. This compressed condition of the spring 37 is held thanks to the antagonist force exerted by the spring 64 having a more significant stiffness, and pushing the head 21 upwards. Also, this closed configuration of the tongs is held by construction during the pipetting operations, which will be described below.

The outside body 24 of the device 20 further includes a shoulder 38 directed downwards, facing and remote a shoulder 40 provided on the bottom part 4, in proximity to the tip 6. Second elastic return means 42, such as a compression spring, are accommodated bearing between both the shoulders 38, 40, in order to constitute a return spring in a top position of the assembly of the gripping device 20 and of the control stem 8 located bearing, in its extension upwards. The return force exerted by this compression spring 42 indeed leads the control stem S to assume its top position with respect to the bottom part 4, a conventional top abutment (not depicted) being provided to this end on any part 2, 4 of the pipette outside body. The spring 42 has a lower stiffness than the one of the spring 64.

As mentioned above, in this embodiment, it is provided an eject stem 46 slidably mounted inside the hollow control stem S. This eject stem 46 has a complementary outside surface to the inside surface of the control stem 8. Its top end is arranged between the control knob 12 and the handle forming body 2, and carries an eject button 48. To do so, the button 48 is carried by a pin-shaped support member 50, which is mounted on the eject stem 8 and which crosses an oblong passageway 52 provided in the control stem, referenced on FIG. 1. The pin 50 is therefore able to slide in the oblong passageway 52 during the relative displacement between both stems 8, 46, corresponding to a sliding along the direction of the axis 10.

The bottom end 54 of the eject stem 46 is here in contact with the top end of the head 21 of the gripping device, both elements therefore simultaneously displacing into translation along the direction 10. The stem 46 therefore fulfils the displacement control function of the head 21 and the tongs 26.

In this embodiment, the pipetting control stem and the eject stem are separated, respectively intended to fulfil the function of pipetting and the function of the capillary-piston assembly ejection, as will be described below.

With reference now to FIGS. 1 to 8, the operation of the pipetting system 100 will be described.

First, with reference to FIG. 1, the operator gripping the pipette by the handle 2 engages the tip 6 in a capillary 80 of a consumable capillary-piston assembly 84, preferably arranged in a box, also referred to as a "rack". By exerting a downward vertical pressure on the pipette 1, he/she obtains the fitting of the capillary 80 on the tip 6, in the same way as the fitting of a conventional capillary or cone on the tip of a conventional air displacement pipette. At this point, the tongs 26 are held in an open configuration, which is automatically obtained after ejection of the previous consumable 84. This configuration with open tongs can also be made by the manufacturer, before marketing the pipette.

Figure 3:
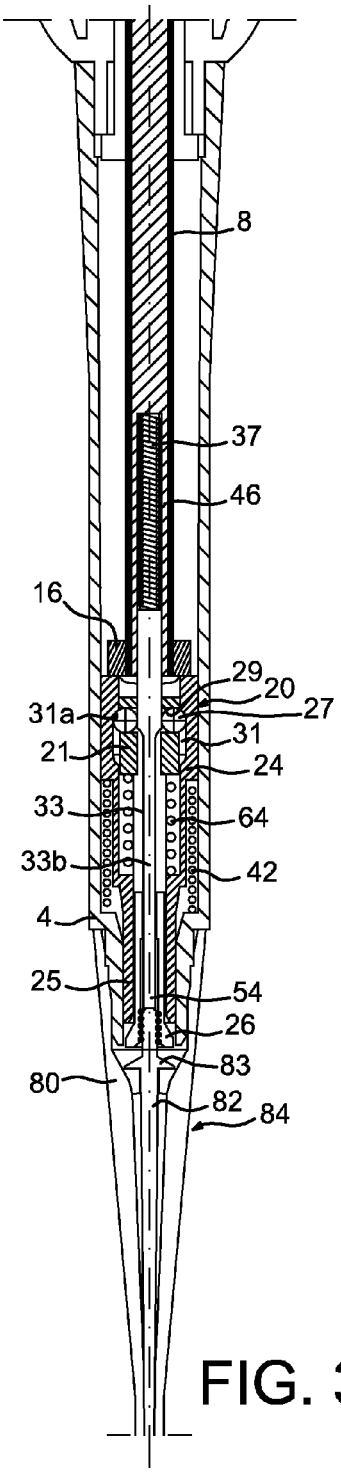
FIGS. 3 to 11 depict different views schematizing the operation of the pipetting system shown in the previous figures.

Then, with reference to FIG. 3, the operator pushes the control knob in order to displace the control stem 8 and the gripping device 20 downwards with the tongs 26 in an open configuration. This displacement is made by the bottom end 16 of the stem 8 bearing against the top end of the outside body 24 of the device 20. The spring 42 therefore tends to compress, whereas the initial compression of the spring 64 remains unchanged. Indeed, the control stem 8 drives with itself the eject stem 46 and its button downwards, such that no relative movement occurs between both stems 8, 46, nor between the outside body 24 and the head 21 respectively controlled by these stems. By way of indication, driving the eject stem 46 by the control stem 8 is made by the top end of the oblong passageway 52 bearing against the pin 50.

During this lowering of the gripping device 20, the tongs 26 held open engage around the top end of the piston 82. Due to their open configuration, the introduction effort can be very small, or even preferentially non-existent.

After introducing the piston 82 between the tongs 26, continuing the lowering of the gripping device 20 leads to the contact between the top end of this piston, and the unlocking control member 54 formed by the bottom end of the axis system 33.

As the lowering continues, the bearing of the top end of the piston 82 on the unlocking control member 54 leads the axis system to displace upwards relative to the translation integral assembly formed by the head 21, the tongs 26, the balls 27 and the outside body 24. When the device 20 reaches a determined position in which the second portion 33*b* of the axis system faces the balls 27, the tongs automatically switch in a closed configuration in which they close on the top end of the piston 82, to provide its holding. This determined position is preferably reached a few millimeters before the outside body 24 is in a bottom abutment relative to the bottom part 4.

The automatic switch from the open configuration to the closed configuration of the tongs 26 is therefore triggered by the displacement of the unlocking control member 54, in translation along the axis 10. This displacement of the member 54 is caused by the bearing of the piston 82 during the downward displacement of the gripping device 20, driven by the control stem 8. More precisely, when the second portion 33*b* of the axis system is facing the locking balls 27, the combined actions of the spring 64 and of the axial top end 31*a* of the groove 31 urge the locking balls to go out from this groove. To do so, the annular axial end 31*a* is preferably in the shape of a tilted, or even rounded surface, directed downwards and radially inwards. This indeed leads the balls 27 to radially retract inwards in the holes 29 of the head 21, until out of the groove 31.

Figure 4:
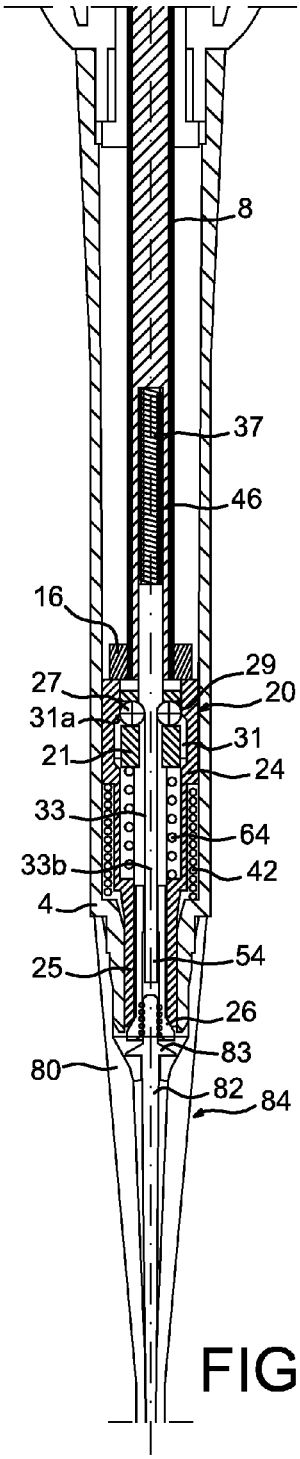
Figure 5:
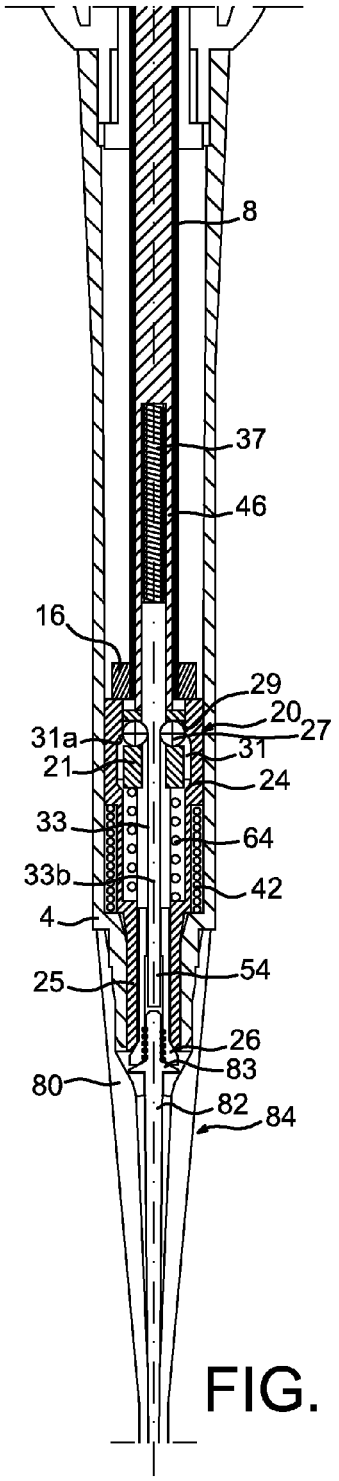

Once the balls are extracted from the groove 31, the partially compressed spring 42 can expand and cause an upwards displacement of the tongs 26 and the head 21 relative to the outside body 24, up to a relative position bringing the tongs 26 in a closed configuration as schematized in FIG. 4. More precisely, it is the outside body 24 which is displaced downwards under the effect of the expansion of the spring 64 by compressing the spring 42 having a lower stiffness, and/or the head 21 and the tongs 26 which raise, for example until the total expansion of the spring 64. It is to be noted that a sort of "click" occurs during the sudden relative displacement between the head 21 and the outside body 24, over a few millimeters and under the effect of the expansion of the spring 64.

Incidentally, after this switch in a closed configuration in which the mechanical bell 25, 26 is closed around the top end of the piston 82, the lowering is continued, still by pressure on the control knob against the return force exerted by the spring 42. During this stroke end, the spring 42 continues to be compressed and the tongs 26 slide along the top end of the piston 82. The system 100 is designed so that the end of the stroke of the outside body 24, corresponding to the maximum compression of the spring 42, also coincides with the axial abutment of the tongs 26 on a collar 83 located at the base of the bottom end of the piston 82, this collar 83 being itself in an axial abutment on the capillary 80. Also, at the end of the lowering of the control stem 8, schematized in FIG. 5, the piston 82 is placed accurately on the gripping device 20, which guarantees a subsequent high precision pipetting.

Figure 6:
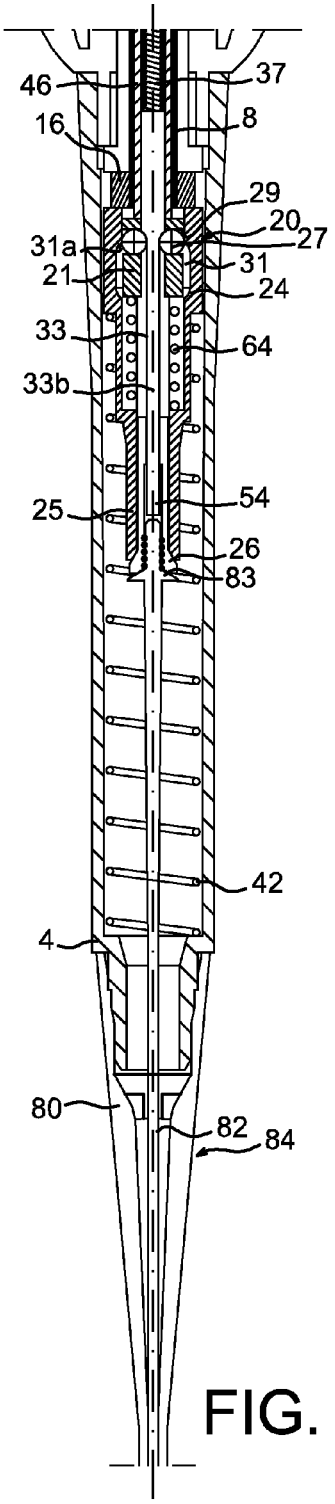

Then, the control knob 12 is released to bring back the control and eject stems 8, 46 in a top position, with the gripping device 20 gripping the piston 82. This top position is shown in FIG. 6. From the latter, the operator can conventionally carry out pipetting operations, using the control knob. Nevertheless, to simplify the liquid sampling process, the control stem 8 can be held in a bottom position shown in FIG. 5 until the sample is sampled, during which the control stem raises with the piston to create the suction of the liquid.

Then the dispense of the sampled liquid is carried out, by displacing the control stem via its button 12, in the same way as the one carried out for gripping the piston. Indeed, the stroke is the same, bringing the control stem 8 in a bottom position until the total compression of the spring 42. During this dispense, the risk that the tongs 26 open and the consumable 84 are ejected is non-existent, since the action on the control knob has no incidence on the spring 64 driving the opening of the tongs, but only an incidence on the spring 42, called the pipetting spring.

Finally, the consumable assembly 84 is ejected, using the eject stem 46 activated by its control knob 48. This ejection is schematized in FIGS. 7 to 11.

Figure 7:
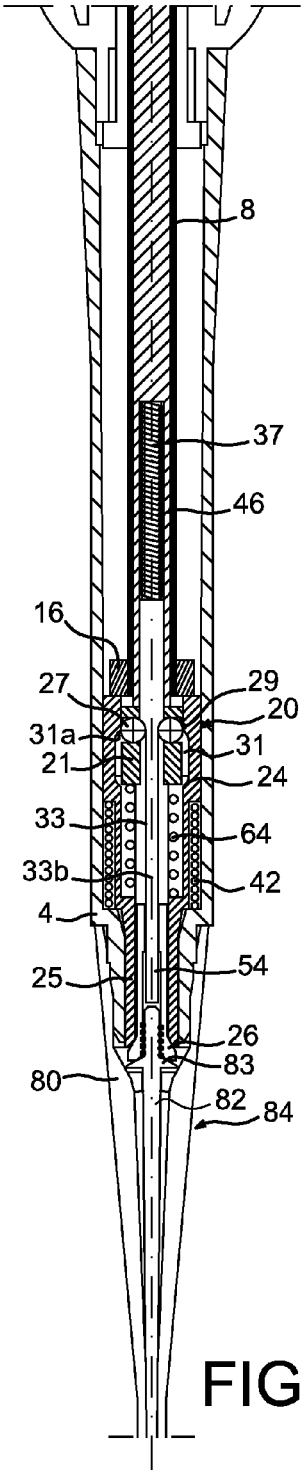

The stiffness of the return spring 64 is such that during a first stroke, this spring nearly does not compress but transfers the strains of the eject stem 46 to the outside body 24 of the gripping device. Therefore, the stem 46, bearing against the top end of the head 21 as shown in FIG. 7, drives with it the whole gripping device 20 downwards. Furthermore, the control stem 8 follows this downward movement, by friction and/or gravity, by remaining bearing against the top end of the outside body 24.

When the displacement of the control stem 8 and of the outside body 24 is stopped in translation by maximum compression of the spring 64, and the eject button 48 continues to be activated downwards, a second stroke of the eject stem then occurs during which a relative displacement of the stem 46 happens with respect to the stem 8 remaining fixed. This relative displacement is allowed by the displacement of the pin 50 in the oblong passageway 52 of the control stem, as mentioned with reference to FIG. 1.

Figure 8:
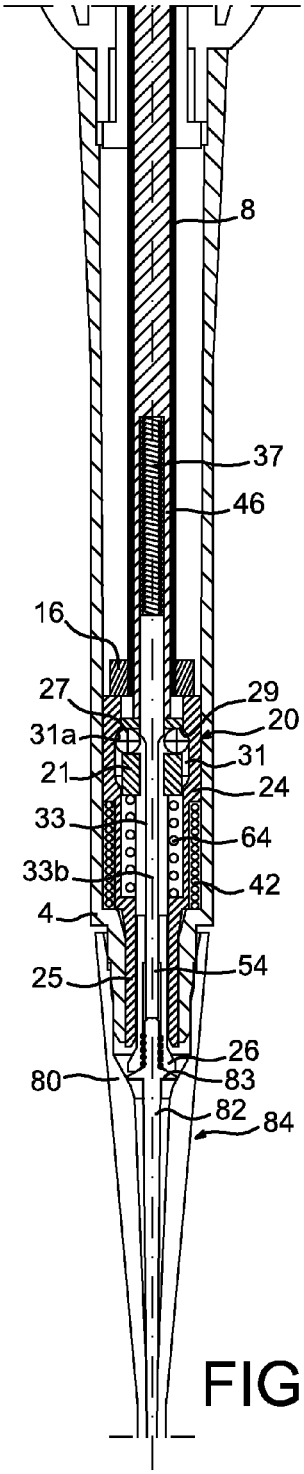

During this second stroke schematized in FIG. 8, the head 21 and the tongs 26 are therefore lowered, and the bearing of the frustoconical transition portion 33*c* on the balls 27 leads the latter to radially displace outwards, by entering the groove 31. Simultaneously, the tongs 26 axially bear on the collar 83 of the piston 82, this collar transferring the eject strain to the capillary 80 which starts disengaging from the tip 6.

Figure 9:
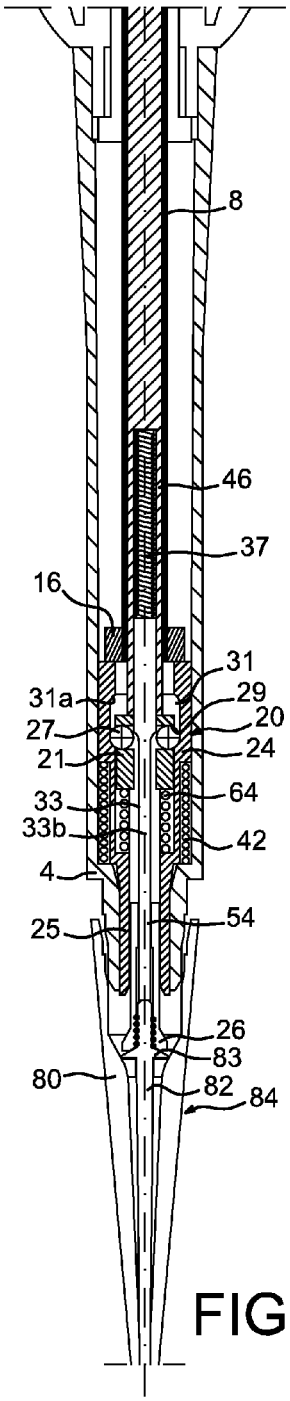

As shown in FIG. 9, the lowering of the eject stem 46 continues, still constraining the spring 64, and with a sliding of the balls 27 at the bottom of the groove 31, downwards down to a bottom axial end of this same groove. The tongs 26 then continue to cause the disengagement of the capillary 80 via the collar 83 of the piston 82, and simultaneously, they gradually open due to the recession of the sheath 25 relative to these tongs, this sheath indeed remaining fixed with respect to the bottom part 4.

The head 21 and the tongs 26 reach their bottom position when the balls 27 arrive in axial abutment in the bottom end of the groove 31. From this moment also shown in FIG. 10, the eject button can no further be depressed. Moreover, at this point, the capillary 80 is totally detached from the tip 6, and the opened tongs 26 have freed the piston 82. The consumable assembly 84 is then ejected, and can fail by gravity in a dedicated container (not depicted).

Figure 10:
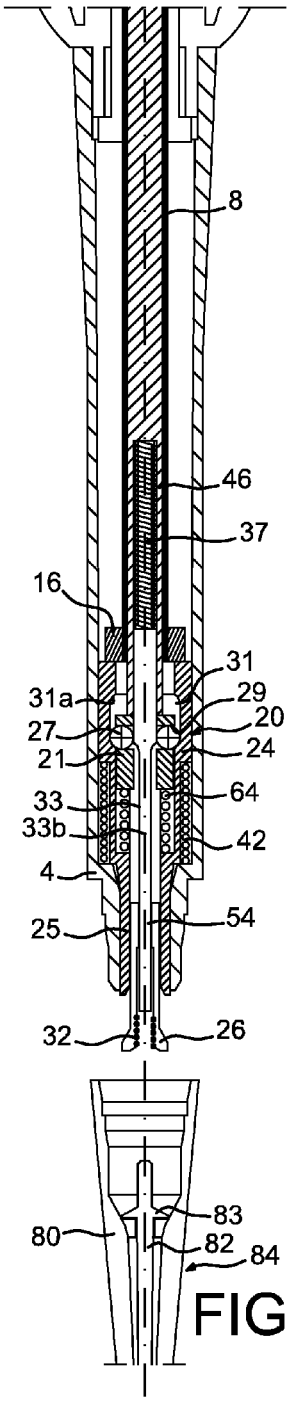

Since the return force of the spring 64 is counteracted by the action of the operator on the eject button, the compression spring 37 can expand and push the axis system 33 downwards, it thus restores the energy previously accumulated during the gripping of the piston, schematized in FIG. 4. During this automatic operation, since the balls are accommodated in the groove 31, the first portion 33*a* having a larger diameter is introduced between the balls 27, as can be seen in FIG. 10.

Figure 11:
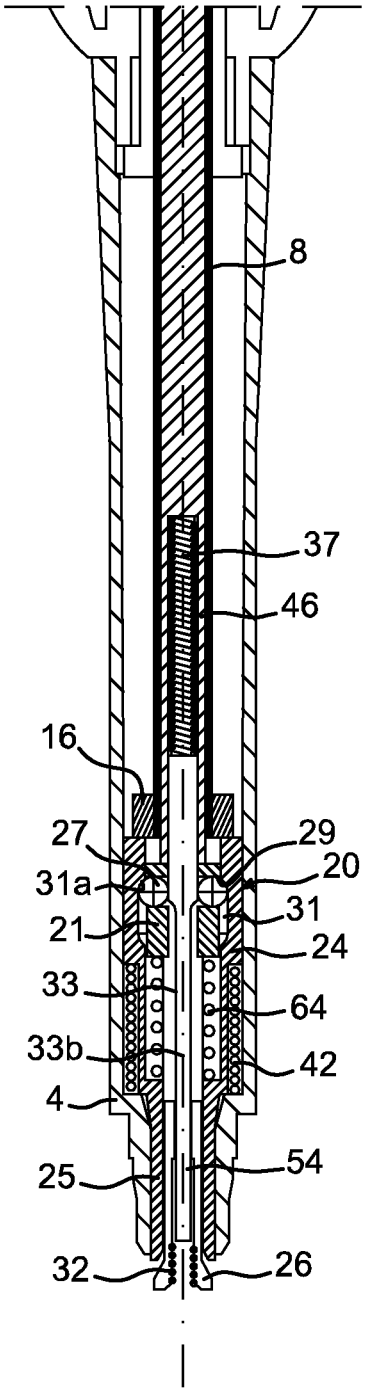

Upon releasing the pressure on the eject button, it is the spring 64 which first expands, which results in raising the assembly formed by the head 21, the tongs 26, the balls 27 which slide in the groove 31, and the axis system 33. Incidentally, it is noted that upon this raising, the relative position of the head 21 and of the axis system 33 does not evolve, since no force is applied on the compression spring 37. Thus, the first portion 33*a* having the larger diameter remains accommodated between the balls 27 during the raising, which is stopped when the balls arrive in contact with the axial top end 31*a* of the groove 31, as can be seen in FIG. 11. In this condition, the gripping device 20 is therefore placed and held with its tongs 26 in an open configuration. This condition is kept during the second part of the raising caused by the expansion of the spring 42, expansion during which the device 20 keeps its configuration shown in FIG. 11, while raising in the bottom part 4. At the end of the raising, the pipette 1 has the shape already described with reference to FIG. 1.

The provided design is advantageous in the sense that during the eject operation of the consumable 84, obtained by depressing the eject button 48 and then releasing this button, the tongs 26 automatically switch from the closed configuration to the open configuration, the latter being kept at the end of the eject operation. Consequently, these tongs are ready again for the simplified gripping, specific to the invention, of the piston of a new consumable 84.

Figure 12:
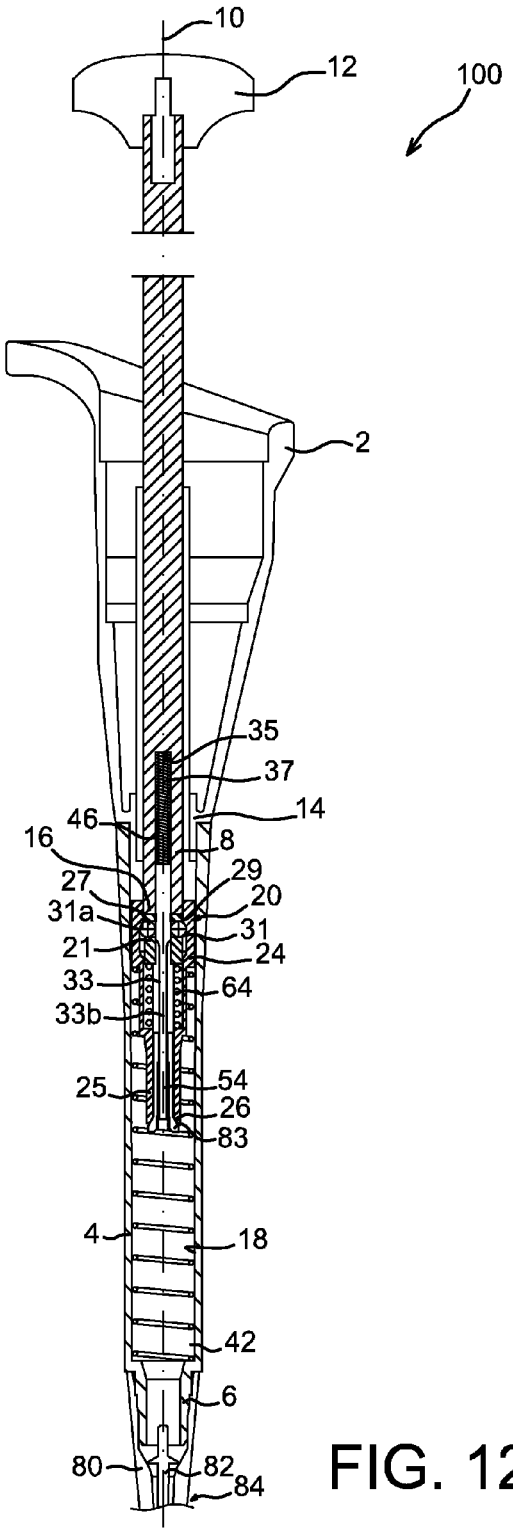
FIG. 12 depicts a longitudinal cross-section view of a positive displacement pipetting system, according to another preferred embodiment of the present invention.

With reference now to FIG. 12, it is depicted a pipetting system 100 according to another preferred embodiment of the present invention. This embodiment has numerous similarities with the previous one. Therefore, in the figures, the elements bearing the same reference numerals correspond to identical or similar elements.

This embodiment thus differs from the previous one simply by the fact that no eject stem distinct from the pipetting control stem 8 is provided, the latter being indeed designed to fulfil the function of a pipetting control stem and the function of the capillary-piston assembly eject stem.

Consequently, the only structural difference with the previous embodiment lies in the fact that it is the control stem 8 which accommodates the axis system 33, the bottom end 16 of this stem 8 bearing against the top end of the head 21 of the gripping device 20, and no longer against the top end of the outside body 24 which remains free.

Figure 13:
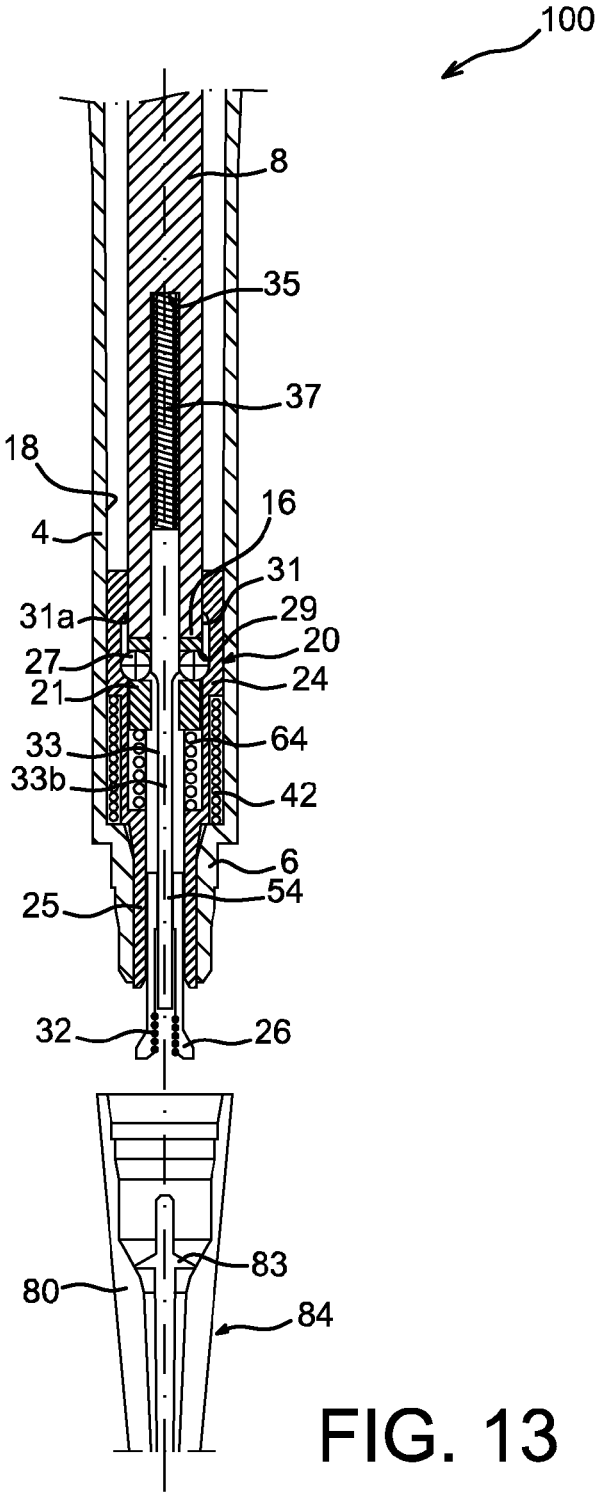
FIG. 13 depicts a view of the pipetting system of the previous figure, in the same condition as the one of FIG. 10 for the previous pipetting system.

The different operations described in relation to the previous embodiment remain generally applicable. The only notable difference is that the ejection operation is made by depressing the control knob 12, and no longer the eject button which has been suppressed. This is illustrated in FIG. 13 showing the system 100 in an identical condition to the one of FIG. 10 for the system of the previous embodiment. In FIG. 13, it is shown that it is the lowering of the control stem 8 which does successively cause the compression of the springs 42 and 64, until bringing the balls 27 in abutment against the bottom end of the groove 31.

Of course, various modifications can be brought by those skilled in the art to the invention which has just been described, only by way of non-limiting examples.

The invention claimed is:

1. A pipetting system comprising:

a positive displacement sampling pipette; and a capillary-piston assembly, a capillary of which is adapted to be fitted on a tip of the pipette, and a piston of which has a top end adapted to be held, during pipetting operations, by a gripping device equipping the pipette, said gripping device comprising a plurality of gripping tongs, wherein, when the capillary of the capillary-piston assembly is fitted on the pipette tip and the gripping device is remote from the piston in an upward position, the gripping device can be displaced downwards with the plurality of gripping tongs in an open configuration, up to a determined position in which the gripping tongs, arranged around the top end of the piston, automatically switch into a closed configuration to hold the top end of the piston, wherein said gripping device includes a tong lock in the open configuration, said tong lock including an unlocking control member slidably arranged between gripping tongs, and wherein the pipette is constructed such that the automatic switching from the open configuration to the closed configuration is triggered by the displacement of the unlocking control member, caused by the top end of the piston bearing against said unlocking control member, during said downward displacement of the gripping device.

2. The system according to claim 1, wherein said gripping device includes:

a head attached to the tongs;

an outside body arranged around the head and the gripping tongs, and including a sheath-shaped bottom end, enabling the gripping tongs to be opened/closed as a function of its relative position with respect to the gripping tongs which it surrounds, said tong lock in the open configuration.

3. The system according to claim 2, wherein said tong lock comprises a locking system with balls.

4. The system according to claim 3, wherein said tong lock comprises locking balls accommodated in holes of said head of the gripping device, said holes radially opening into the outside;

a groove provided on an inside surface of said outside body;

first return elastic means forcing the tongs and the head upwards relative to said outside body; and an axis system comprising at least a first portion and a second portion lower than the first portion, said first and second portions respectively having a first diameter as well as a second diameter smaller than the first diameter, and a lower end of said axis system being formed by said unlocking control member, and wherein said tong lock is constructed such that in the open configuration of the gripping tongs, the locking balls radially protrude outwards from said holes of the head, by being partially accommodated in said groove in which they are held by contact with said first portion of the axis system, said first return elastic means bringing said locking balls in abutment against a top axial end of said groove; and when the second portion of the axis system is facing the locking balls, the combined actions of the first return elastic means and of the top axial end of the groove urge the locking balls to radially retract inwards into the holes of the head, until out of the groove and enabling said first return elastic means to cause an upward displacement of the gripping tongs and of the head relative to said outside body, up to a relative position bringing the gripping tongs into a closed configuration, surrounded by the sheath-forming bottom end of the outside body.

5. The system according to claim 4, further comprising second return elastic means arranged between the outside body of the gripping device and a fixed element of the pipette.

6. The system according to claim 2, wherein said pipette includes a control stem for displacing the head and the gripping tongs attached to the head.

7. The system according to claim 6, wherein said control stem functions as an eject stem of the capillary-piston assembly, and wherein the pipette further includes a pipetting control stem able to drive said gripping device into translation.

8. The system according to claim 6, wherein said control stem functions as a pipetting control stem and an eject stem of the capillary-piston assembly.

9. The system according to claim 1, wherein during an eject operation of the capillary-piston assembly, obtained by depressing an eject button and then releasing said eject button, the gripping tongs of said gripping device automatically switch from the closed configuration to the open configuration, and remaining in the open configuration at an end of said eject operation.

* * * * *